US006505158B1

(12) United States Patent
Conkie

(10) Patent No.: US 6,505,158 B1
(45) **Date of Patent: *Jan. 7, 2003**

(54) SYNTHESIS-BASED PRE-SELECTION OF SUITABLE UNITS FOR CONCATENATIVE SPEECH

(75) Inventor: Alistair D. Conkie, Morristown, NJ (US)

(73) Assignee: AT&T Corp., New York, NY (US)

( * ) Notice: Subject to any disclaimer, the term of this patent is extended or adjusted under 35 U.S.C. 154(b) by 71 days.

This patent is subject to a terminal disclaimer.

(21) Appl. No.: 09/609,889

(22) Filed: Jul. 5, 2000

(51) Int. Cl.[7] ..... G10L 13/08
(52) U.S. Cl. ..... 704/260; 704/268
(58) Field of Search ..... 704/220, 258, 704/260, 254, 268, 255, 262

(56) References Cited

U.S. PATENT DOCUMENTS 5,384,893 A * 1/1995 Hutchins ..... 704/267
5,905,972 A * 5/1999 Huang et al. ..... 704/268
5,913,193 A * 6/1999 Huang et al. ..... 704/258
5,913,194 A * 6/1999 Karaali et al. ..... 704/259
5,937,384 A * 8/1999 Huang et al. ..... 704/256
6,163,769 A * 12/2000 Acero et al. ..... 704/260
6,173,263 B1 * 1/2001 Conkie ..... 704/260
6,253,182 B1 * 6/2001 Acero ..... 704/268
6,304,846 B1 * 10/2001 George et al. ..... 704/270
6,366,883 B1 * 4/2002 Campbell et al. ..... 704/260

* cited by examiner

*Primary Examiner*—Susan McFadden

(57) ABSTRACT

A method and system for providing concatenative speech uses a speech synthesis input to populate a triphone-indexed database that is later used for searching and retrieval to create a phoneme string acceptable for a text-to-speech operation. Prior to initiating the "real time" synthesis, a database is created of all possible triphone contexts by inputting a continuous stream of speech. The speech data is then analyzed to identify all possible triphone sequences in the stream, and the various units chosen for each context. During a later text-to-speech operation, the triphone contexts in the text are identified and the triphone-indexed phonemes in the database are searched to retrieve the best-matched candidates.

10 Claims, 4 Drawing Sheets

SYNTHESIS-BASED PRE-SELECTION OF SUITABLE UNITS FOR CONCATENATIVE SPEECH

TECHNICAL FIELD

The present invention relates to synthesis-based pre-selection of suitable units for concatenative speech and, more particularly, to the utilization of a table containing many thousands of synthesized sentences for selecting units from a unit selection database.

BACKGROUND OF THE INVENTION

A current approach to concatenative speech synthesis is to use a very large database for recorded speech that has been segmented and labeled with prosodic and spectral characteristics, such as the fundamental frequency (F0) for voiced speech, the energy or gain of the signal, and the spectral distribution of the signal (i.e., how much of the signal is present at any given frequency). The database contains multiple instances of speech sounds. This multiplicity permits the possibility of having units in the database that are much less stylized than would occur in a diphone database (a "diphone" being defined as the second half of one phoneme followed by the initial half of the following phoneme, a diphone database generally containing only one instance of any given diphone). Therefore, the possibility of achieving natural speech is enhanced with the "large database" approach.

For good quality synthesis, this database technique relies on being able to select the "best" units from the database—that is, the units that are closest in character to the prosodic specification provided by the speech synthesis system, and that have a low spectral mismatch at the concatenation points between phonemes. The "best" sequence of units may be determined by associating a numerical cost in two different ways. First, a "target cost" is associated with the individual units in isolation, where a lower cost is associated with a unit that has characteristics (e.g., F0, gain, spectral distribution) relatively close to the unit being synthesized, and a higher cost is associated with units having a higher discrepancy with the unit being synthesized. A second cost, referred to as the "concatenation cost", is associated with how smoothly two contiguous units are joined together. For example, if the spectral mismatch between units is poor, there will be a higher concatenation cost.

Thus, a set of candidate units for each position in the desired sequence can be formulated, with associated target costs and concatenative costs. Estimating the best (lowest-cost) path through the network is then performed using, for example, a Viterbi search. The chosen units may then concatenated to form one continuous signal, using a variety of different techniques.

While such database-driven systems may produce a more natural sounding voice quality, to do so they require a great deal of computational resources during the synthesis process. Accordingly, there remains a need for new methods and systems that provide natural voice quality in speech synthesis while reducing the computational requirements.

SUMMARY OF THE INVENTION

The need remaining in the prior art is addressed by the present invention, which relates to synthesis-based pre-selection of suitable units for concatenative speech and, more particularly, to the utilization of a table containing many thousands of synthesized sentences as a guide to selecting units from a unit selection database.

In accordance with the present invention, an extensive database of synthesized speech is created by synthesizing a large number of sentences (large enough to create millions of separate phonemes, for example). From this data, a set of all triphone sequences is then compiled, where a "triphone" is defined as a sequence of three phonemes—or a phoneme "triplet". A list of units (phonemes) from the speech synthesis database that have been chosen for each context is then tabulated.

During the actual text-to-speech synthesis process, the tabulated list is then reviewed for the proper context and these units (phonemes) become the candidate units for synthesis. A conventional cost algorithm, such as a Viterbi search, can then be used to ascertain the best choices from the candidate list for the speech output. If a particular unit to be synthesized does not appear in the created table, a conventional speech synthesis process can be used, but this should be a rare occurrence, Other and further aspects of the present invention will become apparent during the course of the following discussion and by reference to the accompanying drawings.

BRIEF DESCRIPTION OF THE DRAWINGS

Referring now to the drawings.

DETAILED DESCRIPTION

Figure 1:
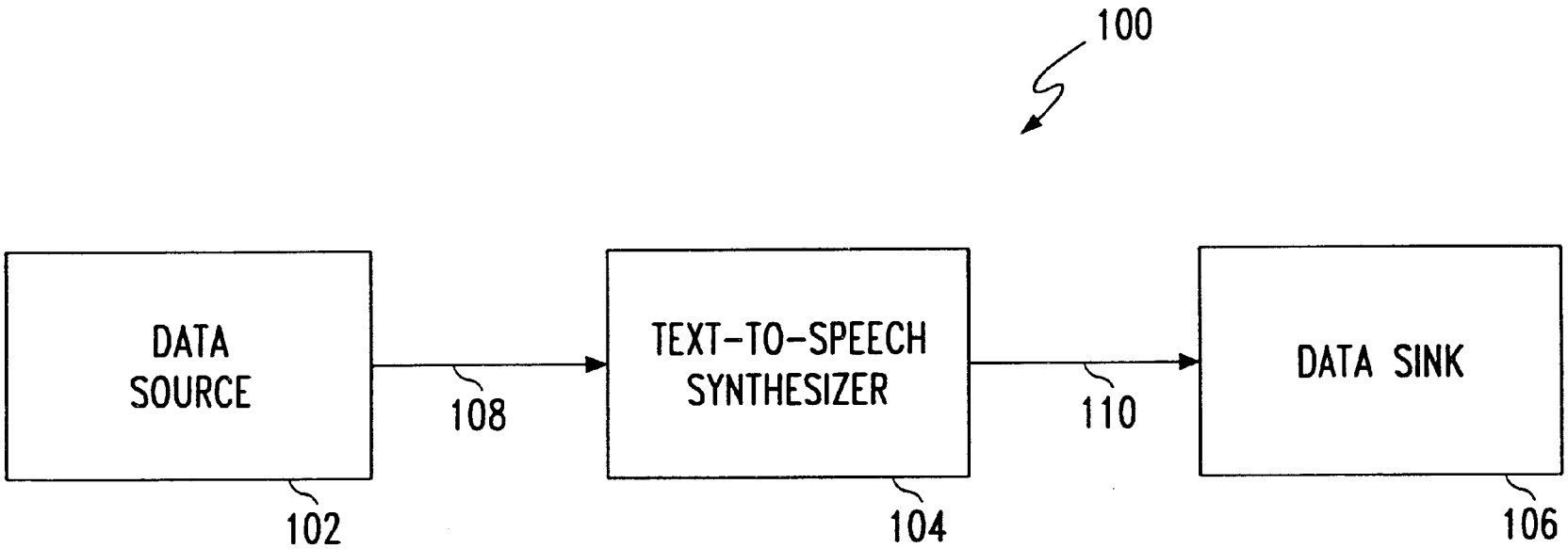
FIG. 1 illustrates an exemplary speech synthesis system for utilizing the triphone selection arrangement of the present invention.

An exemplary speech synthesis system 100 is illustrated in FIG. 1. System 100 includes a text-to-speech synthesizer 104 that is connected to a data source 102 through an input link 108, and is similarly connected to a data sink 106 through an output link 110 Text-to-speech synthesizer 104, as discussed in detail below in association with FIG. 2, functions to convert the text data either to speech data or physical speech. In operation, synthesizer 104 converts the text data by first converting the text into a stream of phonemes representing the speech equivalent of the text, then processes the phoneme stream to produce to an acoustic unit stream representing a clearer and more understandable speech representation. Synthesizer 104 then converts the acoustic unit stream to speech data or physical speech.

Data source 102 provides text-to-speech synthesizer 104, via input link 108, the data that represents the text to be synthesized. The data representing the text of the speech can be in any format, such as binary, ASCII, or a word processing file. Data source 102 can be any one of a number of different types of data sources, such as a computer, a storage device, or any combination of software and hardware capable of generating, relaying, or recalling from storage, a textual message or any information capable of being translated into speech. Data sink 106 receives the synthesized speech from text-to-speech synthesizer 104 via output link 110. Data sink 106 can be any device capable of audibly outputting speech, such as a speaker system for transmitting mechanical sound waves, or a digital computer, or any combination or hardware and software capable of receiving, relaying, storing, sensing or perceiving speech sound or information representing speech sounds.

Links 108 and 110 can be any suitable device or system for connecting data source 102/data sink 106 to synthesizer 104. Such devices include a direct serial/parallel cable connection, a connection over a wide area network (WAN) or a local area network (LAN), a connection over an intranet, the Internet, or any other distributed processing network or system. Additionally, input link 108 or output link 110 may be software devices linking various software systems.

Figure 2:
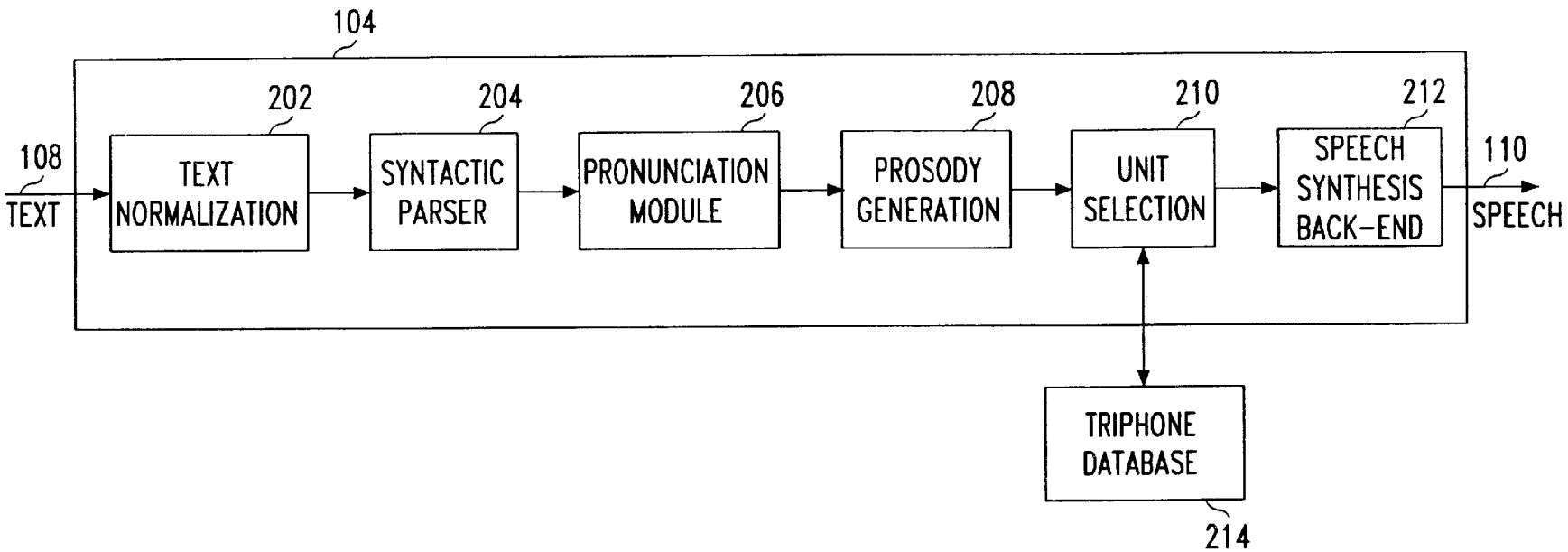
FIG. 2 illustrates, in more detail, an exemplary text-to-speech synthesizer that may be used in the system of FIG. 1.

FIG. 2 contains a more detailed block diagram of text-to-speech synthesizer 104 of FIG. 1. Synthesizer 104 comprises, in this exemplary embodiment, a text normalization device 202, syntactic parser device 204, word pronunciation module 206. prosody generation device 208, an acoustic unit selection device 210, and a speech synthesis back-end device 212. In operation, textual data is received on input link 108 and first applied as an input to text normalization device 202. Text normalization device 202 parses the text data into known words and further converts abbreviations and numbers into words to produce a corresponding set of normalized textual data. For example, if"St." is input, text normalization device 202 is used to pronounce the abbreviation as either "saint" or "street", but not the /st/ sound. Once the text has been normalized, it is input to syntactic parser 204. Syntactic processor 204 performs grammatical analysis of a sentence to identify the syntactic structure of each constituent phrase and word. For example, syntactic parser 204 will identify a particular phrase as a "noun phrase" or a "verb phrase" and a word as a noun, verb, adjective, etc. Syntactic parsing is important because whether the word or phrase is being used as a noun or a verb may affect how it is articulated. For example, in the sentence "the cat ran away", if "cat" is identified as a noun and "ran" is identified as a verb, speech synthesizer 104 may assign the word "cat" a different sound duration and intonation pattern than "ran" because of its position and function in the sentence structure.

Once the syntactic structure of the text has been determined, the text is input to word pronunciation module 206. In word pronunciation module 206, orthographic characters used in the normal text are mapped into the appropriate strings of phonetic segments representing units of sound and speech. This is important since the same orthographic strings may have different pronunciations depending on the word in which the string is used. For example, the orthographic string "gh" is translated to the phoneme /f/ in "tough", to the phoneme /g/ in "ghost", and is not directly realized as any phoneme in "though". Lexical stress is also marked. For example, "record" has a primary stress on the first syllable if it is a noun, but has the primary stress on the second syllable if it is a verb. The output from word pronunciation module 206, in the form of phonetic segments, is then applied as an input to prosody determination device 208. Prosody determination device 208 assigns patterns of timing and intonation to the phonetic segment strings. The timing pattern includes the duration of sound for each of the phonemes. For example, the "re" in the verb "record" has a longer duration of sound than the "re" in the noun "record". Furthermore, the intonation pattern concerns pitch changes during the course of an utterance. These pitch changes express accentuation of certain words or syllables as they are positioned in a sentence and help convey the meaning of the sentence. Thus, the patterns of timing and intonation are important for the intelligibility and naturalness of synthesized speech. Prosody may be generated in various ways including assigning an artificial accent or providing for sentence context. For example, the phrase "This is a test!" will be spoken differently from "This is a test?". Prosody generating devices are well-known to those of ordinary skill in the art and any combination of hardware, software, firmware, heuristic techniques, databases, or any other apparatus or method that performs prosody generation may be used. In accordance with the present invention, the phonetic output from prosody determination device 208 is an amalgam of information about phonemes, their specified durations and F0 values.

The phoneme data, along with the corresponding characteristic parameters, is then sent to acoustic unit selection device 210, where the phonemes and characteristic parameters are transformed into a stream of acoustic units that represent speech. An "acoustic unit" can be defined as a particular utterance of a given phoneme. Large numbers of acoustic units may all correspond to a single phoneme, each acoustic unit differing from one another in terms of pitch, duration and stress (as well as other phonetic or prosodic qualities). In accordance with the present invention a triphone database 214 is accessed by unit selection device 210 to provide a candidate list of units that are most likely to be used in the synthesis process. In particular and as described in detail below, triphone database 214 comprises an indexed set of phonemes, as characterized by how they appear in various triphone contexts, where the universe of phonemes was created from a continuous stream of input speech. Unit selection device 210 then performs a search on this candidate list (using a Viterbi "least cost" search, or any other appropriate mechanism) to find the unit that best matches the phoneme to be synthesized. The acoustic unit output stream from unit selection device 210 is then sent to speech synthesis back-end device 212, which converts the acoustic unit stream into speech data and transmits the speech data to data sink 106 (see FIG. 1), over output link 110.

Figure 3:
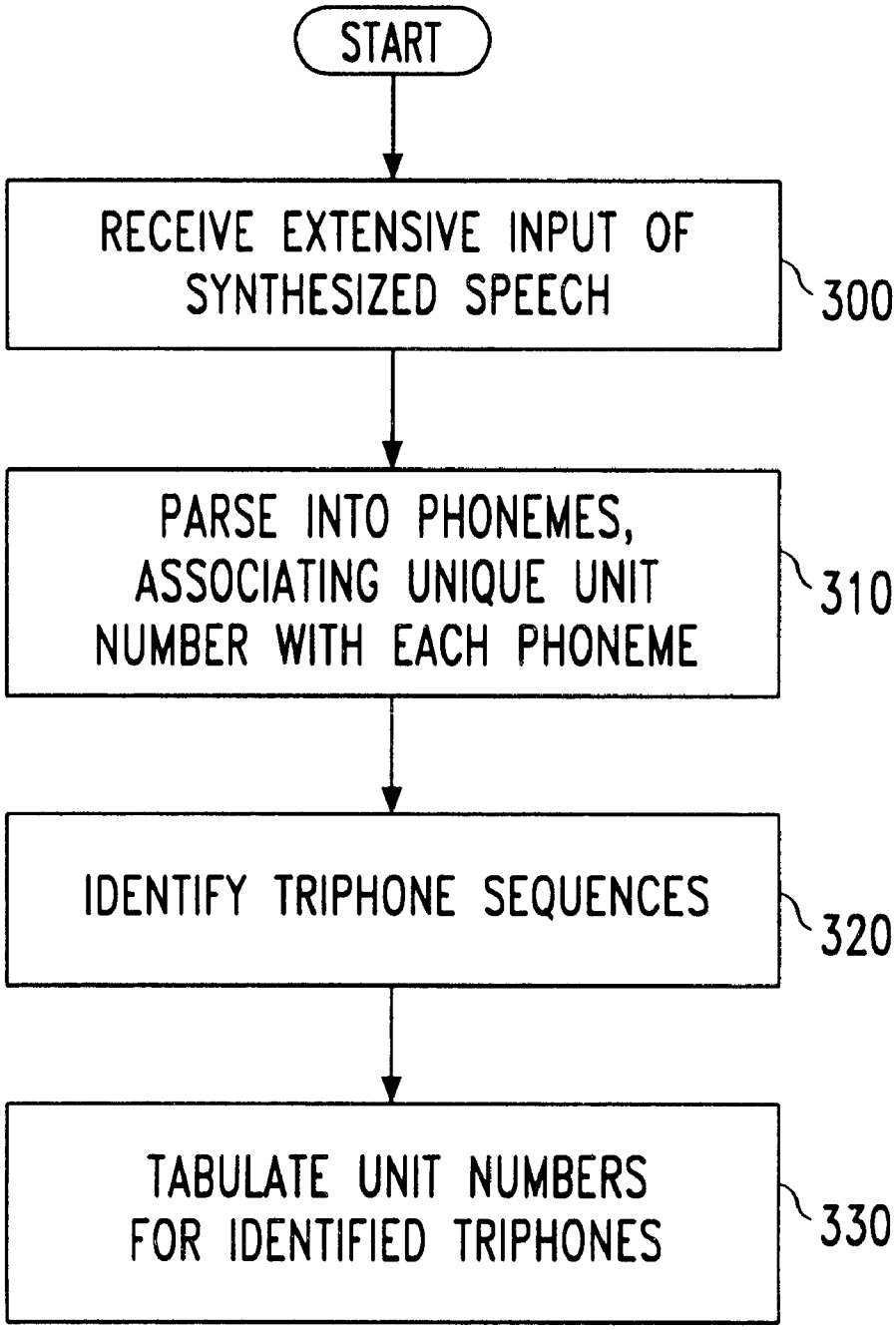
FIG. 3 is a flowchart illustrating the creation of the unit selection database of the present invention.

In accordance with the present invention, triphone database 214 as used by unit selection device 210 is created by first accepting an extensive collection of synthesized sentences that are compiled and stored. FIG. 3 contains a flow chart illustrating an exemplary process for preparing unit selection triphone database 214, beginning with the reception of the synthesized sentences (block 300). In one example, two weeks' worth of speech was recorded and stored, accounting for 25 million different phonemes. Each phoneme unit is designated with a unique number in the database for retrieval purposes (block 310). The synthesized sentences are then reviewed and all possible triphone combinations identified (block 320). For example, the triphone /k//oe//t/ (consisting of the phoneme /oe/ and its immediate neighbors) may have many occurrences in the synthesized input. The list of unit numbers for each phoneme chosen in a particular context are then tabulated so that the triphones are later identifiable (block 330). The final database structure, therefore, contains sets of unit numbers associated with each particular context of each triphone likely to occur in any text that is to be later synthesized.

Figure 4:
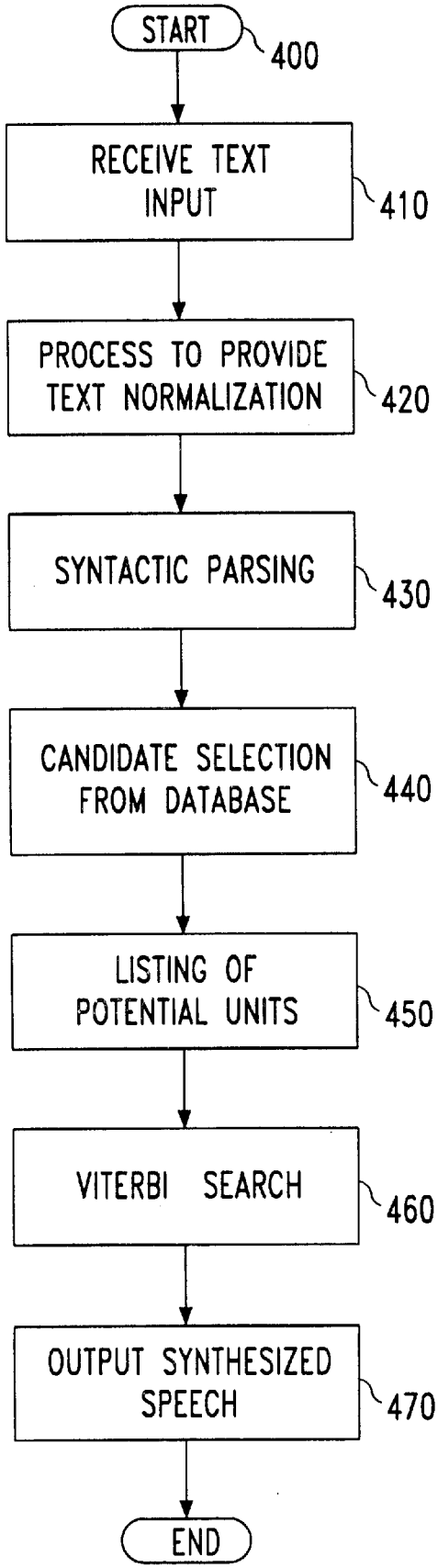
FIG. 4 is a flowchart illustrating an exemplary unit (phoneme) selection process using the unit selection database of the present invention.

An exemplary text to speech synthesis process using the unit selection database generated according to the present invention is illustrated in the flow chart of FIG. 4. The first step in the process is to receive the input text (block 410) and apply it as an input to text normalization device (block 420). The normalized text is then syntactically parsed (block 430) so that the syntactic structure of each constituent phrase or word is identified as, for example, a noun, verb, adjective, etc. The syntactically parsed text is then expressed as phonemes (block 440), where these phonemes (as well as information about their triphone context) are then applied as inputs to triphone selection database 214 to ascertain likely synthesis candidates (block 450). For example, if the sequence of phonemes /k//oe//t/ is to be synthesized, the unit numbers for a set of N phonemes /oe/ are selected from the database created as outlined above in FIG. 3, where N can be any relatively small number (e.g., 40–50). A candidate list of each of the requested phonemes are generated (block 460) and a Viterbi search is performed (block 470) to find the least cost path through the selected phonemes. The selected phonemes may be then be further processed (block 480) to form the actual speech output.

What is claimed is:

1. A method of synthesizing speech from text input using unit selection, the method comprising the steps of:

a) creating a triphone preselection database from an input stream of speech synthesis by collecting units observed to occur in particular triphone contexts, a triphone comprising a sequence of three phoneme units;

b) receiving a stream of input text to be synthesized;

c) converting the received input text into a sequence of phonemes by parsing the input text into identifiable syntactic phrases;

d) comparing the sequence of phonemes formed in step c), also considering neighboring phonemes so as to form input triphones, to a plurality of commonly occurring triphones stored in the triphone preselection database to select a plurality of N phoneme units as candidates for synthesis;

e) selecting a set of candidates of step d) by applying a cost process to each path through the plurality of N phoneme units associated with each phoneme sequence and choosing a least cost set of phoneme units;

f) processing the least cost phoneme units selected in step e) into synthesized speech; and g) outputting the synthesized speech to an output device.

2. The method as defined in claim 1 wherein in performing step a) the following steps are performed:

1) providing a continuous input stream of synthesized speech for a predetermined time period t;

2) parsing the speech input stream into phoneme units;

3) finding the unique database unit number with each phoneme;

4) identifying all possible triphone combinations from the parsed phonemes; and 5) tabulating unit numbers for the identified phonemes so as to index the database by the identified triphones.

3. The method as defined in claim 2 wherein in performing step a1), the continuous input stream continues for a time period of approximately two weeks.

4. The method as defined in claim 1 wherein in performing step c), the converting process uses half-phonemes to create phoneme sequences, with unit spacing between adjacent half-phonemes.

5. The method as defined in claim 1 wherein in performing step e), a Viterbi search mechanism is used.

6. A method of creating a triphone preselection database for use in generating synthesized speech from a stream of input text, the method comprising the steps of:

a) providing a continuous input stream of synthesized speech for a predetermined time period t;

b) parsing the speech input stream into phoneme units;

c) finding the unique database unit number associated with each phoneme;

d) identifying all possible triphone combinations from the parsed phonemes; and e) tabulating unit numbers for the identified phonemes so as to index the database by the identified triphones.

7. The method as defined in claim 6 wherein in performing step a), the continuous input stream continues for a time period of approximately two weeks.

8. A system for synthesizing speech using phonemes, comprising a linguistic processor for receiving input text and converting said text into a sequence of phonemes;

a database of indexed phonemes, the index based on precalculated costs of phonemes in various triphone sequences;

a unit selector, coupled to both the linguistic process and the triphone database, for comparing each received phoneme, including its triphone context, to the indexed phonemes in said database and selecting a set of candidate phonemes for synthesis; and a speech processor, coupled to the unit selector, for processing selected candidate phonemes into synthesized speech and providing as an output the synthesized speech to an output device.

9. A system as defined in claim 8 wherein the database comprises an indexed set of phonemes, based on triphone context, created from a stream of speech continuing from a predetermined period of time t.

10. A system as defined in claim 9 wherein the predetermined period of time t is approximately two weeks.

* * * * *